United States Patent [19]

Schwarz

[11] 4,257,222

[45] Mar. 24, 1981

[54] SEAL CLEARANCE CONTROL SYSTEM FOR A GAS TURBINE

[75] Inventor: Frederick M. Schwarz, Glastonbury, Conn.

[73] Assignee: United Technologies Corporation, Hartford, Conn.

[21] Appl. No.: 58,591

[22] Filed: Jul. 18, 1979

Related U.S. Application Data

[62] Division of Ser. No. 862,748, Dec. 21, 1977, Pat. No. 4,213,296.

[51] Int. Cl.[3] ..... F02C 7/26

[52] U.S. Cl. ..... 60/39.02; 60/39.14 R; 415/175; 415/178

[58] Field of Search ..... 60/39.02, 39.14 R, 39.83; 415/115, 116, 117, 175, 176, 178

[56] References Cited

U.S. PATENT DOCUMENTS

| | | | |
|---|---|---|---|
| 3,825,365 | 9/1974 | Peng | 415/116 |
| 3,966,354 | 6/1976 | Patterson | 415/116 |
| 3,975,901 | 8/1976 | Hallinger et al. | 415/117 |
| 4,069,662 | 1/1978 | Redinger et al. | 415/116 |

*Primary Examiner*—Louis J. Casaregola
*Attorney, Agent, or Firm*—Robert C. Walker

[57] ABSTRACT

A gas turbine engine has an engine casing surrounding the turbine section and an internal chamber or jacket which separates the casing from blade tip seals supported by the casing. To maintain an adequate clearance between the turbine blades and the seals during engine startup and acceleration, a portion of the hot combustion gases passing through the turbine blades is bled through the chamber in heat exchange relationship with the casing. The hot gases expand the casing at a faster rate than otherwise to approximate the thermal growth rate of the turbine rotor and maintain a adequate clearance between the turbine blade tips and seals. During steady-state operation relatively cool air bled from the compressor is ducted through the chamber to cool the engine casing and hold the proper clearance between the blades and the seals. A valve connected with the chamber controls the flow of hot combustion gases and cool compressor air through the chamber so that the engine casing can be expanded or contracted to control the blade clearance.

3 Claims, 4 Drawing Figures

SEAL CLEARANCE CONTROL SYSTEM FOR A GAS TURBINE

This is a division of application Ser. No. 862,748 filed on Dec. 21, 1977 now U.S. Pat. No. 4,213,296.

BACKGROUND OF THE INVENTION

The present invention relates to a gas turbine engine in which a proper clearance between the turbine blade tips and the seals or shrouds connected with the engine casing is maintained during various modes of engine operation.

It is well known in the prior art such as exemplified in U.S. Pat. Nos. 3,391,904, 3,583,824 and 4,019,320 to utilize cooling air from the compressor or fan in a gas turbine engine to control the expansion and contraction of blade tip seals and the supporting portion of the engine casing for optimum turbine performance. If the running clearances between the turbine blades and the seals are excessive, specific fuel consumption and power output from the engine suffer. On the other hand, adequate clearance must be maintained during all modes of engine operation to prevent destructive interference of the blades and seals.

The maintenance of a fixed seal clearance in the turbine section of an engine during all modes of operation is complicated by thermal transients in both the turbine rotor and the engine casing. As an engine starts up thermal growth of the casing generally lags far behind the relatively quick thermal growth of the rotor. To prevent interference between the blade tips and casing supported seals, a relatively large clearance is needed to accommodate the initial, rapid growth of the turbine rotor. When the thermal transients have leveled out, expansion of the engine casing has caught up with that of the rotor and again an excessive clearance will exist between the turbine blades and the seals. Such clearance in the steady-state condition as well as startup conditions allows hot combustion gases to leak past the turbine blades which reduces engine output and increases specific fuel consumption.

The seal clearance problem is further aggravated if the engine is accelerated from idle conditions soon after startup. The centrifugal growth of the rotor simply contributes to the rapid thermal growth rate. If cooling air is used in moderate amounts throughout the startup and high power operation to cool the engine casing, thermal growth rates of the casing are further restricted.

One solution employed in current engines utilizes large amounts of compressor air which under startup conditions is relatively warm and will initially aid expansion of the engine casing. This solution, however, is not altogether satisfactory due to the low temperature of the air employed.

Another solution also employs large amounts of compressor air which is ducted over the exterior of the engine casing during steady-state operation. The compressor air under these circumstances is relatively cool and shrinks the heated casing closer to the rotor. Both of these solutions are discussed in the above-referenced U.S. Pat. No. 3,583,824 but necessitate large amounts of air from the compressor. Thus while the turbine performance is enhanced compressor work is wasted.

It is also known from U.S. Pat. No. 3,736,751 to utilize the hot gases within the turbine section of the engine to control the positioning of a face sealing element.

Hot gas from the engine escapes past the sealing element and flows through a thermally expandable control tube that supports the sealing element. Expansion of the tube closes the gap between the rotating blades and nonrotating seal element and reduces the flow of hot gases to the tube. Cold air is also fed through the tube and discharged to a low-pressure region by means of a restrictor. A preselected clearance or gap exists between the sealing element and blades when the flow of hot and cold fluid is balanced. In this prior art apparatus, however, the seal clearance involved is an axial clearance rather than blade tip clearance at the engine casing.

It is a principal object of the present invention to control clearance between the turbine blades and tip seals supported from the engine casing. An adequate but tight clearance is maintained throughout various modes of engine operation in spite of the different thermal growth rates associated with the turbine rotor and casing.

SUMMARY OF THE INVENTION

The present invention resides in a method and apparatus for controlling the clearance between the turbine rotor blades and blade tip seals supported from an engine casing in a gas turbine engine. A portion of the hot combustion gases is bled from the flow path in the turbine and is ducted over the engine casing during engine startup to heat and expand the casing at an accelerated rate approximating the thermal growth of the turbine rotor. After thermal transients associated with startup have leveled out, a portion of the air or fluid medium from which the combustion gases are generated in a combustion process is bled from the compressor and ducted over the walls of the engine casing to maintain a desired clearance.

The apparatus employs heat-exchanging means including a fluid conduit means extending into the turbine section in heat-exchange relationship with the engine casing. The fluid conduit means, in one form, a chamber or jacket within the engine casing, has a connection with the gas flow in the turbine to receive the relatively hot gases and has a downstream end from which the hot gases are discharged. The upstream end of the conduit means is connected with the compressor to also receive the relatively cool compressor air. Flow control means regulate the flow of both the hot combustion gases and the compressor air to control expansion and contraction of the engine casing and establish proper seal clearance.

DETAILED DESCRIPTION OF PREFERRED EMBODIMENTS

Figure 1:
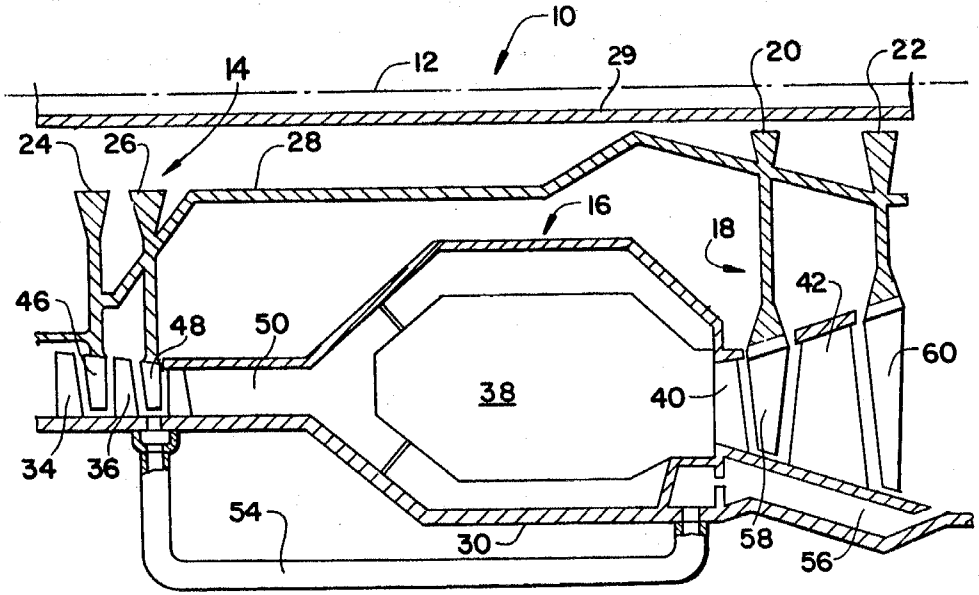
FIG. 1 is a fragmentary sectional view showing parts of the compressor section, the combustion section and the turbine section of a gas turbine engine in schematic form.

FIG. 1 illustrates schematically the principal components of a gas turbine engine 10 that utilizes the present invention. The engine is constructed symmetrically about a centerline or engine axis 12 and thus only the lower portion of the engine is illustrated. The forward or front of the engine includes a compressor section 14 which ingests a fluid working medium such as air and discharges the air at an elevated pressure into a combustion section 16. Within the combustion section the air is combined with fuel in a combustion process and is discharged at high velocity along a combustion gas flow path through the turbine section 18. The hot combustion gases drive the turbine rotors 20 and 22 which are connected to the final compressor stages 24 and 26 by means of the drive shaft 28. The gases may also drive other turbine rotors in subsequent stages of the turbine section to produce mechanical power in the inner shaft 29 and may be expelled through a diffuser at the rear of the engine to generate a propulsive thrust.

An engine casing 30 encloses and reacts loads and stresses between the principal components of the gas turbine engine and serves as a structural mount or support for the stator vanes 34 and 36 in the compressor section, the burner cans or combustion chambers 38 distributed circumaxially about the engine axis 12 in the combustion section and the stator vanes 40 and 42 in the turbine section. The rotor blades 46 and 48 attached to the final compressor stages 24 and 26 respectively rotate between the stator vanes 34 and 36 and pump the compressed air into the annular diffuser 50 from which the air discharges into the various combustion chambers 38. A cooling air bleed pipe 54 is connected to the engine casing at the last stage 26 of the compressor section 14 to bleed a limited portion of the compressed air rearwardly around the combustion section to a heat exchanging conduit in the form of an annular chamber or jacket 56 between the engine casing 30 and the gas flow path through the turbine section. As explained in greater detail below, the cooling air is utilized to control thermal expansion which affects clearance between the shrouds or tip seals and the turbine rotor blades 58 in the turbine section.

Figure 2:
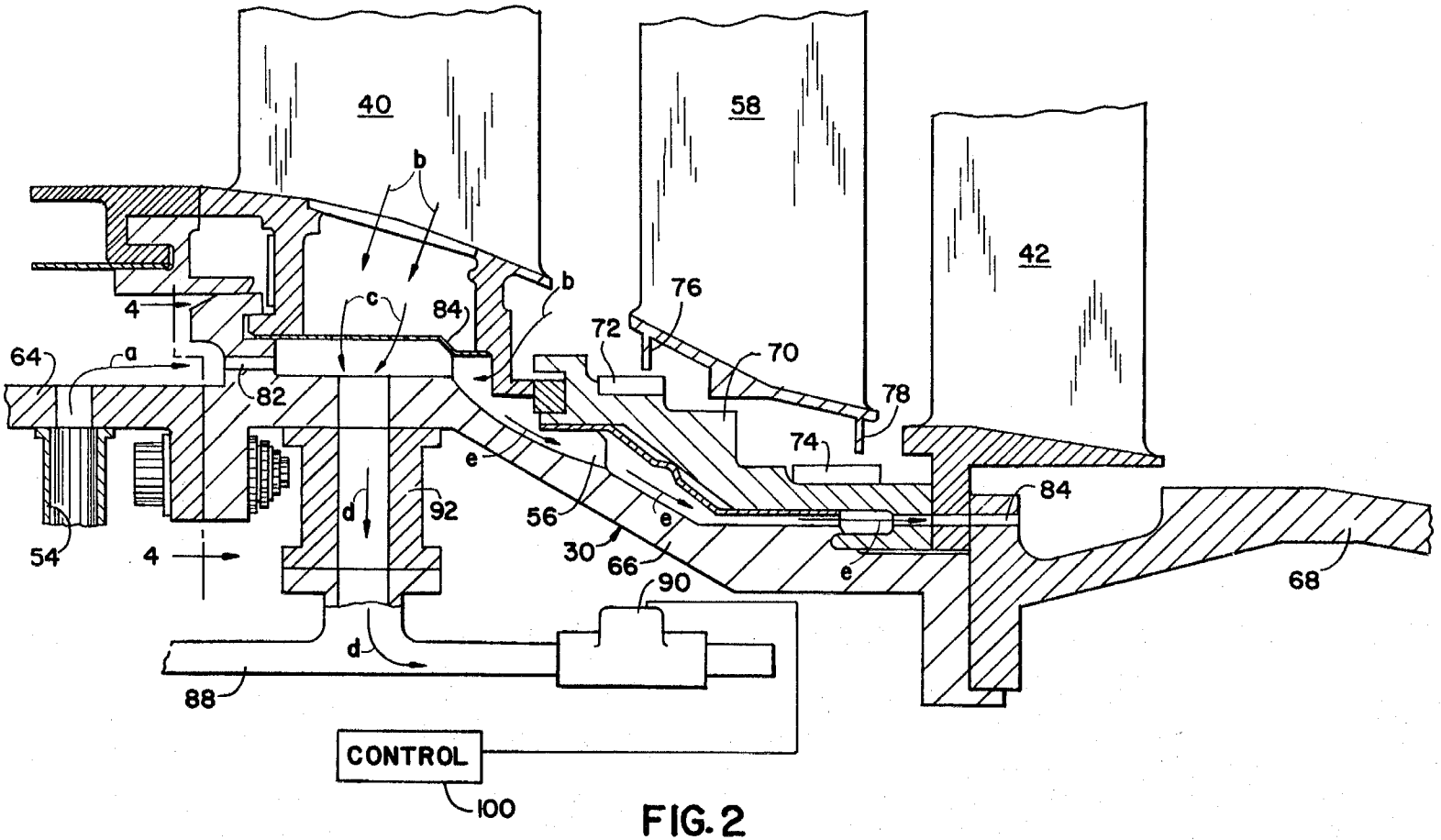
FIG. 2 is an enlarged fragmentary view of the turbine section of the engine and shows details of the present invention in one embodiment.

FIG. 2 illustrates in detail the structure which controls seal clearance in the turbine section in accordance with the present invention. It will be observed that the engine casing 30 in this region of the engine is comprised of a plurality of interconnected shell sections 64, 66 and 68. These sections circumscribe the engine and may be segmented for ease of manufacture and engine assembly. The stator vanes 40 are fixedly attached to the shell section 66 and form an annular array of inlet vanes for guiding the hot combustion gases along the gas flow path at the entrance of the turbine section. The stator vanes 42 downstream of the first stage turbine blades 58 are also fixedly attached to the casing between the shell sections 66 and 68. Like the vanes 40, the stator vanes 42 are also arranged in an annular array about the engine axis and guide the hot combustion gases from the rotor blades 58 to rotor blades in subsequent stages of the turbine section.

A shroud or blade tip seal 70 is connected to the shell section 66 between the attachments of stator vanes 40 and 42, and bears a pair of wear strips 72 and 74 which are radially disposed from a corresponding pair of knife edges 76 and 78 respectively. The seal 70 including the wear strips is segmented for ease of installation in the shell section 66 and is supported in spaced relationship from the section 66 to form one portion of the annular heat exchanging chamber or jacket 56 shown schematically in FIG. 1. The knife edges 76 and 78 extend circumaxially about the turbine rotor at the tips of the blades 58 and cooperate with the strips to form a labyrinth type of gas seal for the hot combustion gases in the flow path over the blades. Thus the combustion gases cannot bypass the turbine blades and engine efficiency is maintained provided that a tight or relatively small clearance is maintained between the knife edges and the wear strips. The wear strips are generally constructed of an abradible material such as honeycomb while the knife edges are structural elements of steel or other materials.

The heat exchanging jacket 56 formed between the shell section 66 and the seal 70 extends both upstream and downstream of the seal in order to conduct heat-exchanging fluid along the inner wall of the casing 30 and thereby control contraction or expansion of the casing. With the seal 70 supported from the casing, clearance between the turbine and seals is controlled by heating and expanding the casing when the clearance is too small or by cooling and contracting the casing when the clearance is too large.

Figure 3:
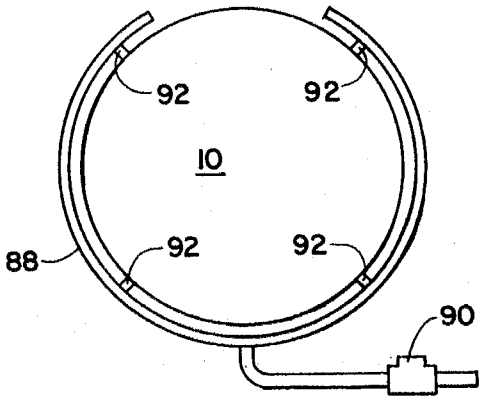
FIG. 3 is a schematic illustration of a vent valve and manifold connected to the gas turbine engine at several points in accordance with the embodiment of the invention illustrated in FIG. 2.
Figure 4:
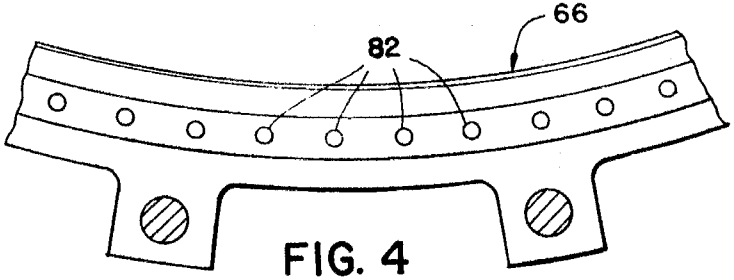
FIG. 4 is a fragmentary sectional view of the engine casing as seen along the sectioning line 4—4 in FIG. 2.

At the upstream end, the jacket 56 connects with the pipe 54 delivering cooling air from the compressor. The air flows into the jacket as indicated by the arrow a and enters the downstream section of the jacket through an annular series of orifices 82, also shown in FIG. 4, which extend axially through the supporting structure for the stator vanes 40. To guide the cooling air within the jacket, a baffle ring 84 is sandwiched between the root section of the stator vanes and the shell 66 and from this point the cooling air may be directed either downstream through the jacket 56 to an annular series of exit apertures 84, similar to but larger than the orifices 82, or, as indicated by the arrows d, through a manifold 88 and an electrically actuated vent valve 90. The vent valve 90 exhausts to a low pressure area such as the atmosphere surrounding the casing, and is actuated by means of a control 100 described in greater detail below. The manifold 88 is connected to the engine casing 30 at several points by means of a plurality of stub connectors 92 distributed about the engine 10 as illustrated in FIG. 3.

OPERATION

In operation, the seal clearances are controlled by expanding or contracting the engine casing 30 with fluids ducted through the heat-exchanging jacket 56 formed in part by the casing shell section 66. The expansion of the jacket during engine startup conditions is caused by the hot combustion gases which leak from the gas flow path between the vanes 40 and seals 70, and is controlled to approximate the expansion rate of the turbine rotor. Contraction of the jacket during steady state operation at power is caused by the cooling air delivered to the jacket from the compressor through the bleed pipe 54. The vent valve 90 and control 100 serve as the flow control means and determine which of the heat-exchange fluids, that is either the hot combustion gases or the cooler compressor air, passes through the jacket 56. Flow control is established by regulating the pressure within the jacket and preferably the fluids are controlled to maintain a substantially constant, tight clearance between the blades and seals during all engine operating modes. Since the compressor air is delivered to the orifices 82 at substantially the same elevated pressure as that discharged from the compressor, and since the combustion gases entering the turbine section have a slightly lower pressure, a slight pressure gradient can exist between the hot gas flow path over the blades and the surrounding jacket when the valve 90 is closed, and that gradient can be reversed by the valve to cause either the hot combustion gases or the cooling air to flow through the jacket to the exit apertures 84.

During engine startup when the turbine rotor blades as well as the engine casing are cool, the vent valve 90 is opened by the control 100, and a relatively low pressure level exists within the jacket 56. Hot gases from the gas flow path through the turbine enter the jacket 56 as indicated by the arrows b through fluid communications with the jacket formed by the leakage paths and openings between and around the stator vanes 40 and the seals 70. A portion of the hot gases bled from the flow path enters the manifold 88 as indicated by the arrows c along with most or all of the relatively cool compressor air that passes through the orifices 82. However, a substantial portion of the hot gases also passes over the inner wall of the shell section 66 as indicated by the arrows e and causes the casing 30 to be rapidly heated and expanded. At the same time, thermal transients of the turbine rotor and blades 58 cause the rotor to grow radially outward toward the seal 70, but the expansion of the casing 30 produces similar radial movement of the seals so that destructive interference never takes place.

In most practical embodiments of the invention, the thermal transients of the turbine rotor and the blades cause more rapid radial growth than the hot gases over the casing, and a slightly larger clearance is required during startup conditions to accommodate such growth. When the engine has reached a steady state operating condition, however, such clearance is eliminated by closing the vent valve 90 and allowing the pressure level within the annular jacket 56 to increase above that in the gas flow path. The increased pressure is caused by cooling air entering the jacket through the orifices 82. The air flows through the jacket to the downstream apertures 84 and then joins the gas flow path within the shell section 68. With the vent valve 90 closed, some of the cooling air from the compressor flows through the baffle 84 and back through the leakage paths into the hot combustion gases in a direction opposite the arrows b and c. The larger portion of the cooling air, however, flows over the inner wall of the casing 30, cools the shell section 66 and contracts the casing to reduce the clearance between the seals and turbine blade tips.

The control 100 which regulates the vent valve 90, and correspondingly the pressure and flow through the jacket 56, may respond to various signals in order to actuate the valve. The control may respond to pressure levels within the engine which are representative of turbine or compressor speed or gas leakage past the blade tips. Alternately the control may respond directly to rotor speed. Also, the control may monitor temperatures within the turbine section which are an indirect measurement of seal clearance caused by expansion and contraction of the turbine components. Still further, the control may be a time-delay switch with actuates a predetermined period after engine startup.

In summary, the present invention relates to the control of seal clearance in a gas turbine engine and particularly control of seal clearance while thermal transients are operative during engine startup periods. In order to accelerate the thermal growth of the engine casing 30 to a rate generally commensurate with that of the turbine rotor, hot gases from the gas flow path are ducted through a conduit means or jacket 56 in heat-exchange relationship with the casing. Once a steady-state operating condition has been reached and the thermal transients have leveled out, a relatively cool flow of air discharged from the compressor is ducted through the jacket to shrink the casing and close down the seal clearance if necessary. One means for controlling flow of either the hot combustion gases or the cooler compressor air is the vent valve 90 and valve control 100 that regulate pressure within the jacket.

While the present invention has been disclosed in a preferred embodiment, it should be understood that numerous modifications and substitutions can be had without departing from the spirit of the invention. For example, the fluid conduit means or jacket 56 illustrated in FIG. 2 services only a single stage of the turbine section; however, it should be clear that several stages may be serviced by the same basic structure. The vent valve represents only one means for controlling flow of heating and cooling fluids through the jacket and it should be readily apparent to those skilled in the art that a control valve installed in the delivery pipe 54 would inhibit the delivery of cooling air during the engine startup mode and allow hot gases to move through the jacket. In such case, the orifices 82 are not needed. The illustrated system including vent valve 90 is also ideally suited to engine structures in which a double-walled casing, rather than the independent bleed pipe 54 shown in the drawings, is employed to deliver cooling air from the compressor.

As described, the cooling air from the compressor does not flow through the jacket 56 when the vent valve 90 is opened since the manifold 88 absorbs substantially all of the air that passes through the orifices 82, and hot combustion gases flow through the jacket 56 only when the valve is open. Conversely, none of the hot gases flows through the jacket 56 when the valve 90 is closed because the pressure of the cooling air is slightly greater than that of the hot gases in the flow path through the turbine which produces a positive pressure gradient between the jacket and the gas flow path. Thus, the hot combustion gases and the cooling air flow through the jacket 56 during different or nonoverlapping periods. With more sophisticated valving and controls, it is possible that hot and cold fluids could be mixed if desired to more precisely regulate the contraction and expansion of the engine casing 30.

Accordingly, the present invention has been described in a preferred embodiment by way of illustration rather than limitation.

I claim:

1. A method of controlling clearance between the turbine rotor blades and blade tip seals supported from an engine casing in a gas turbine engine which produces hot combustion gases at an elevated pressure and directs the gases along a gas flow path over the rotor blades for driving the turbine, comprising the steps of: providing a heat exchanging chamber within the engine between the engine casing and the gas flow path over the blades, providing leakage paths for the hot combustion gases from the gas flow path into the heat exchanging chamber within the engine casing, and regulating the pressure in the heat exchanging chamber above and below the pressure of the hot gases in the gas flow path to control bleeding of a portion of the hot combustion gases from the gas flow path into the heat exchanging chamber during engine start-up to heat and expand the casing as thermal growth of the turbine rotor takes place.

2. A method of controlling the clearance between the turbine rotor blades and blade tip seals as defined in claim 1 wherein the engine also includes a compressor delivering a fluid working medium to a combustion chamber to generate the hot combustion gases and wherein further steps in the method include: ducting a portion of the working medium from the compressor to the heat exchanging chamber; and the step of regulating the pressure in the heat exchanging chamber includes admitting the fluid working medium into the chamber to raise the chamber pressure above the pressure of the hot gases in the gas flow path.

3. A method of controlling clearance between turbine blades and blade tip seals as defined in claim 1 wherein the step of regulating the pressure in the heat exchanging chamber includes venting the chamber to lower the pressure below the pressure of the hot gases in the gas flow path.

* * * * *